United States Patent [19]

Lambert

[11] 4,285,157

[45] Aug. 25, 1981

[54] TOY RACING SET

[75] Inventor: Gerard L. Lambert, Torrance, Calif.

[73] Assignee: Mattel, Inc., Hawthorne, Calif.

[21] Appl. No.: 110,974

[22] Filed: Jan. 10, 1980

[51] Int. Cl.[3] ..... A63H 33/00; A63H 11/10; E01B 23/00; B65D 69/00

[52] U.S. Cl. ..... 46/202; 238/10 A; 46/1 K; 46/11; 104/55; 206/579

[58] Field of Search ..... 46/202, 1 K, 11, 1 C, 46/12, 111, 112, 201; 104/55; 238/10 R, 10 A, 10 B, 10 C, 10 D, 10 E, 10 F, 12; 206/335, 315 R, 579

[56] References Cited

U.S. PATENT DOCUMENTS

| | | | |
|---|---|---|---|
| 1,914,116 | 6/1933 | Ford | 238/10 A |
| 2,590,676 | 3/1952 | Bradley | 238/10 A |
| 2,616,630 | 11/1952 | Michele | 238/10 A |
| 3,209,491 | 10/1965 | Roeper | 46/202 |
| 3,438,145 | 4/1969 | Genin | 238/10 F |
| 3,490,169 | 1/1970 | Tweed | 206/315 |
| 3,599,768 | 8/1971 | Connolly | 46/1 K |
| 3,703,989 | 11/1972 | Tomiyama | 46/43 |
| 3,735,923 | 5/1973 | Brigham et al. | 104/55 |
| 3,769,743 | 11/1973 | Benkoe et al. | 46/1 C |

*Primary Examiner*—G. E. McNeill
*Assistant Examiner*—Michael J. Foycik
*Attorney, Agent, or Firm*—Reagin & King

[57] ABSTRACT

A toy racing set including at least one powered vehicle, a length of flexible track, and a carrying case. The carrying case folds out to form a track upon which the vehicle may run. The case may also be used when closed with the flexible track to provide a loop-the-loop track for a powered vehicle.

3 Claims, 5 Drawing Figures

TOY RACING SET

BACKGROUND OF THE INVENTION

This invention relates to toys and, more particularly, to toy racing sets in which powered vehicles are raced around closed courses.

There have been many toys devised over the years. Few of these toys are designed to entertain a child in cramped quarters such as the back seat of a car or the seat of a train or bus. This is especially true of toys such as racing sets which use powered automobiles. Normally, the track layout for such racing sets is much too large to fit within the space. Moreover, such cramped environments do not always provide level surfaces upon which the layouts can be placed. Those few toys which have been designed for used in cramped spaces offer very few play options because of the restricted size of the space.

It is an object of this invention to provide a new and improved toy racing set.

It is another object of this invention to provide a toy racing set capable of use in a compact space.

It is still another object of this invention to provide a toy racing set offering different track layouts which can be set up in a compact space.

SUMMARY OF THE INVENTION

These and other objects of the invention are accomplished by a toy racing set which includes at least one powered vehicle, a short piece of flexible track section, and a carrying case. The carrying case folds out to form a high walled track upon which the vehicle may be run. The case, when emptied, closes to provide a loop-the-loop track for a powered vehicle.

Other objects, features, and advantages of the invention will become apparant from a reading of the specification when taken in conjunction with the drawings in which like reference numerals refer to like elements in the several views.

DESCRIPTION OF THE PREFERRED EMBODIMENT

Figure 1:
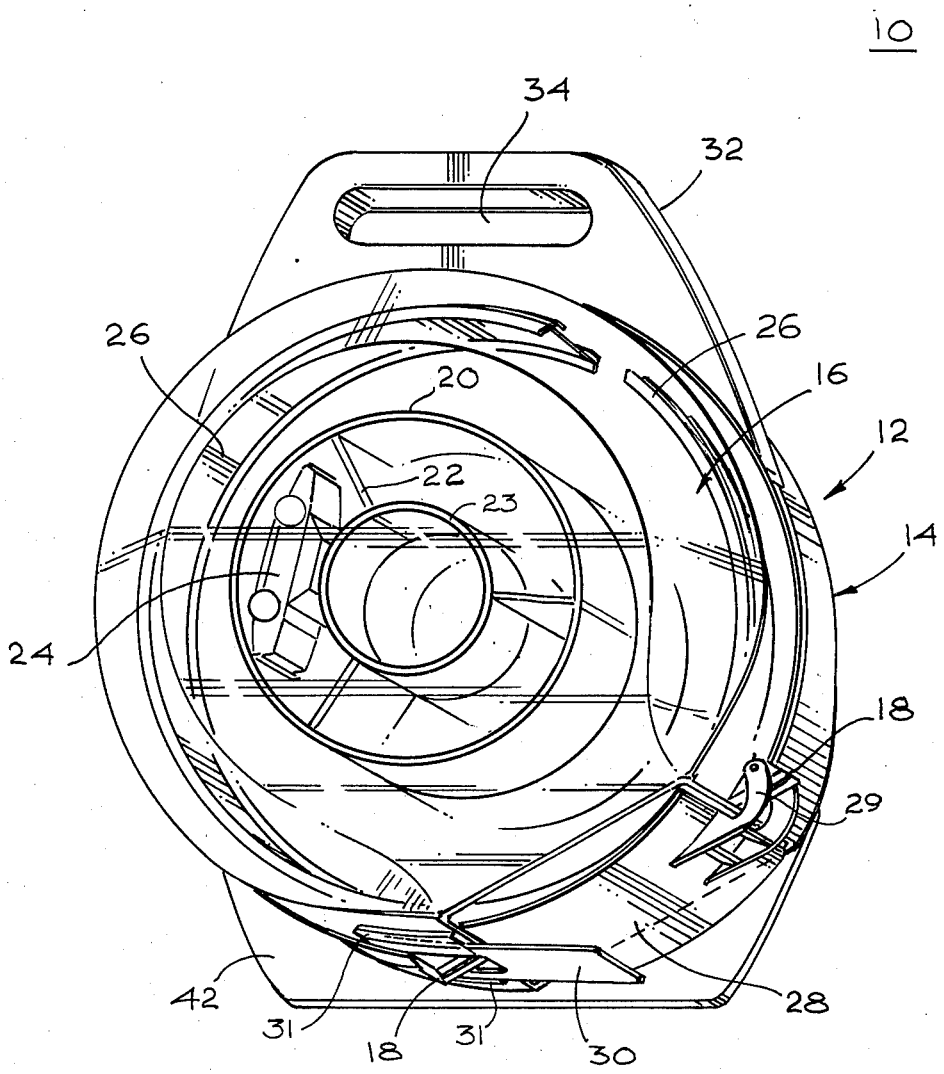
FIG. 1 is a perspective view of a carrying case constructed in accordance with the invention having inside thereof a toy racing vehicle and a section of flexible track.

Referring now to the drawings and, more particularly, to FIG. 1, there is shown a perspective view of a toy racing set 10 which includes a carrying case 12 having a base 14 and a top 16 joined to one another by hinges 18. The base 14 and the top 16 may be constructed of moldable plastic material such as high impact styrene. In a preferred embodiment, the base 14 is opaque and colored while the top is clear so that one may view the interior thereof. The base 14 and the top 16 are generally shaped like pans and hinged together to provide an enclosed inner section. Each of the base 14 and the top 16 includes a central cylinder 20 molded therein which extends from the exterior surface inwardly. Each of the central cylinders 20 also has partitions 22 surrounding an inner cylinder 23. When the top 16 is closed on the bottom 14, the sections 20 fold together to form a single closed cylinder divided into three sections surrounding the inner cylinders 23. A number of toy vehicles such as the toy automobile 24 shown in FIG. 1 may be placed in the sections when the carrying case 12 is closed. Also positioned within the space provided between the base 14 and the top 16 is a strip of flexible track 26.

When the base 14 and the top 16 are closed an opening is formed in the case 12 between the hinges 18 over which is positioned a cover 28. The cover 28 is itself rotatably connected by a hinge 29 to the right-hand one of the two hinges 18. The cover may be maintained in the closed position while the carrying case 12 is being carried by a connector 30 which slides into a pair of slots 31 on the exterior of the case 12. The case 12 is also provided with a handle 32 which may be molded as an integral part of the base 14 and which has an aperture 34 therein by which the case 12 may be carried.

The case 12 may be formed from one of the moldable plastic materials which are well known in the art. The flexible track may be constructed of a moldable plastic material such as polypropylene which will allow it to be folded and placed within the case 12. The car 24 may be constructed of any of a number of different materials known in the art. It is desirable that the car 24 be powered in some manner, such as by a spring motor or the like, and that it be of such dimensions that it will fit within the sections provided in the central cylinder 20.

Figure 2:
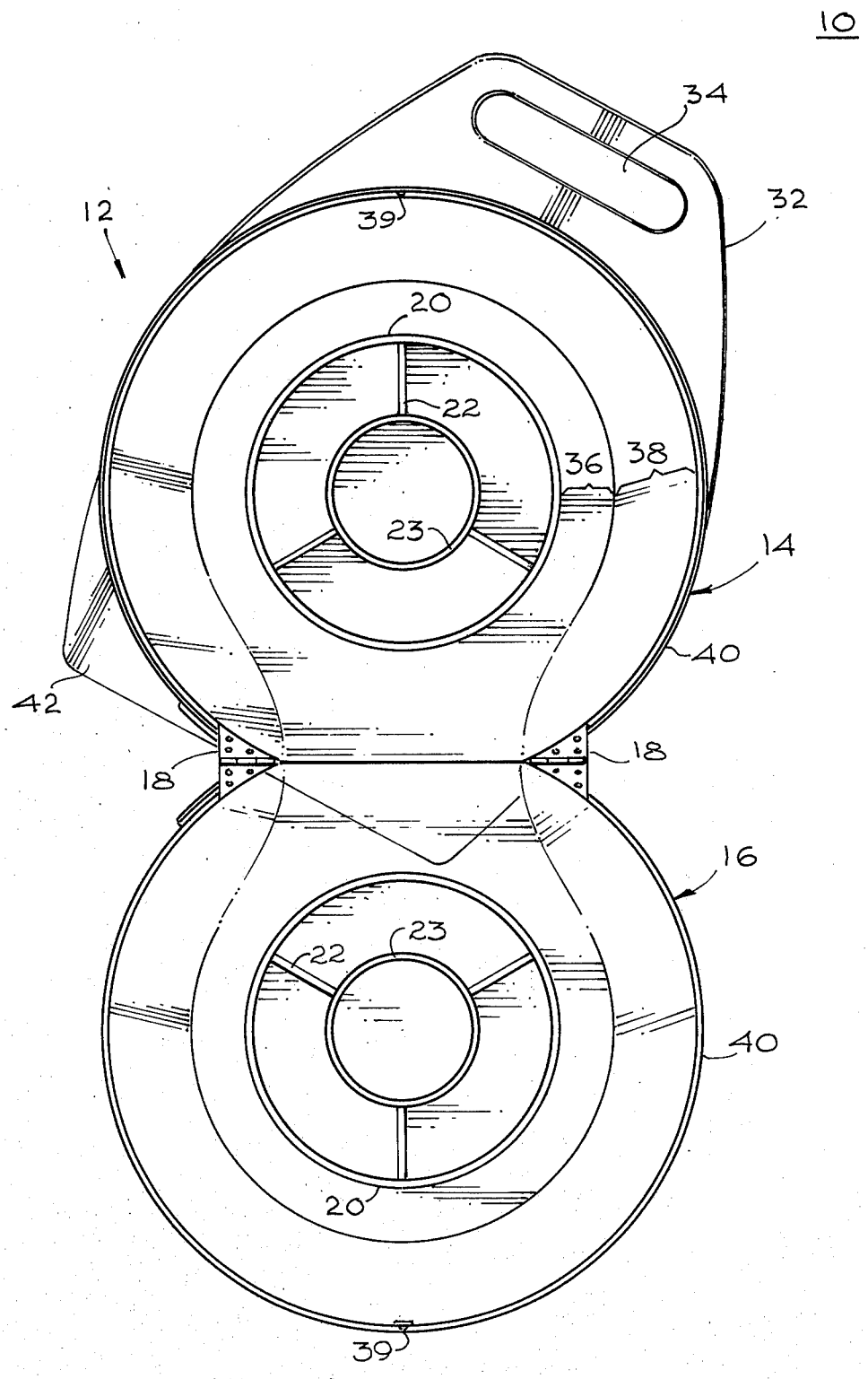
FIG. 2 is a front view of the carrying case shown in FIG. 1 opened so that it may be used as a track layout for a powered vehicle.
Figure 5:
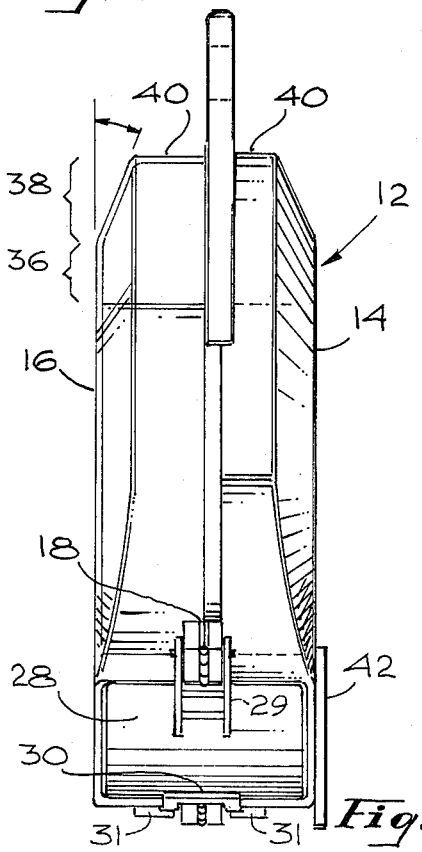
FIG. 5 is an end view of a closed carrying case such as that shown in FIG. 1.

Referring now to FIG. 2, there is shown a front view of the carrying case 12 with the top 16 folded out so that the edge thereof lies in the same plane as the edge of the base 14. In this position, the base 14 and the top 16 provide a figure eight track layout through which the car 24 may negotiate. As may be seen, the track layout comprises a flat bottom section surrounding the central cylinders 20 of each of the base 14 and the top 16. The flat portion adjacent the central cylinders 20 is designated 36 in FIG. 2. Outwardly of the flat portion 36 lies an inclined section 38 which slopes downwardly from the flat portion 36 at approximately 25° and terminates in end walls 40 which lie perpendicular to the plane of the track. This may be seen more clearly in FIG. 5 which is an end view showing the two sections 14 and 16 closed together. The inclined section 38 rounds into the flat section 36 to provide a relatively smooth path for a car progressing around the two sections in a figure eight pattern. The steep walls 40 assure that a racing vehicle remains on the track even though the track is inclined from the horizontal.

In order to unfold the case 12 to realize the track layout shown in FIG. 2, it is necessary that the cover 28 be removed from the right-hand hinge 18 shown in FIG. 1. This is done by spreading the two sections of the plastic hinge 29 shown in FIG. 1 by which the cover 28 is connected to the case 12. In opening the case 12, it is also necessary to remove the connector 30 so that the hinges 18 may be operated. A snap lock 39 of a type well known in the art holds the top 16 closed to the base 14.

Figure 3:
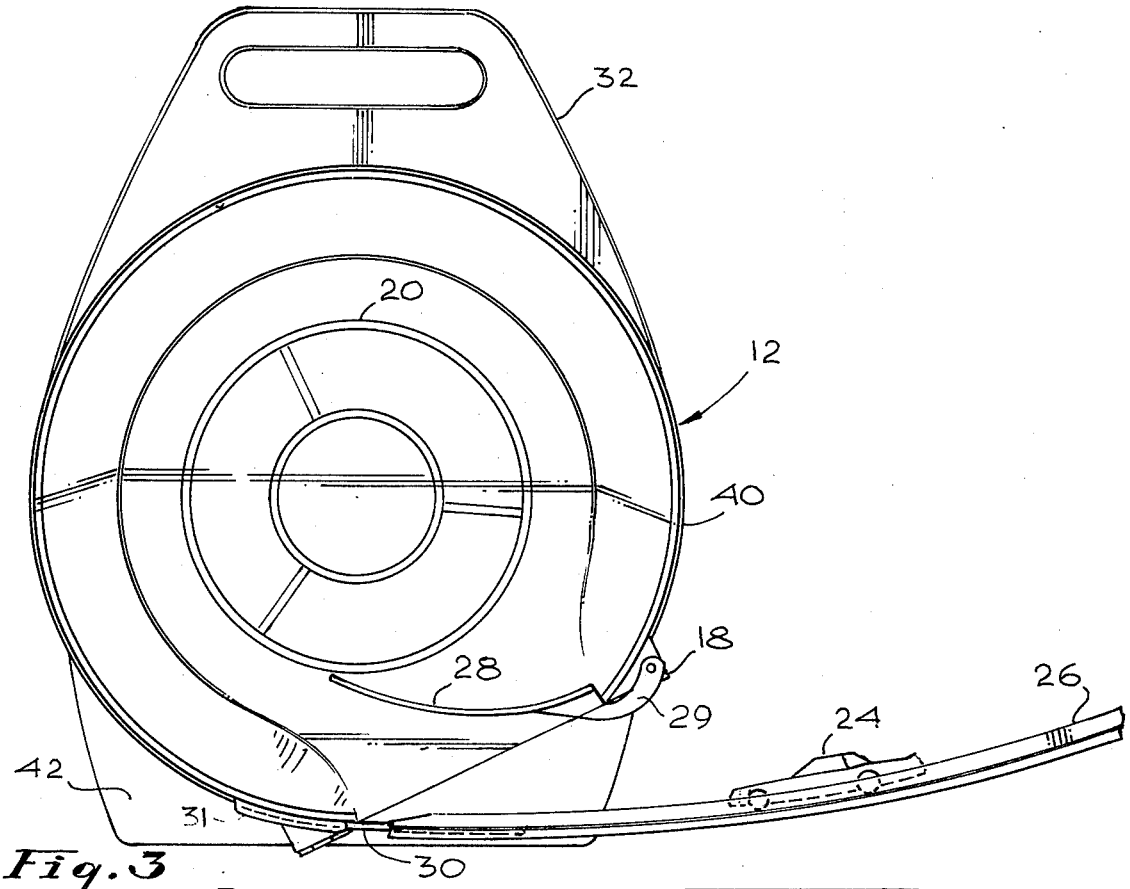
FIGS. 3 and 4 are front views of the carrying case shown in FIG. 1 illustrating the manner in which it may be used to provide a closed loop-the-loop track layout.
Figure 4:
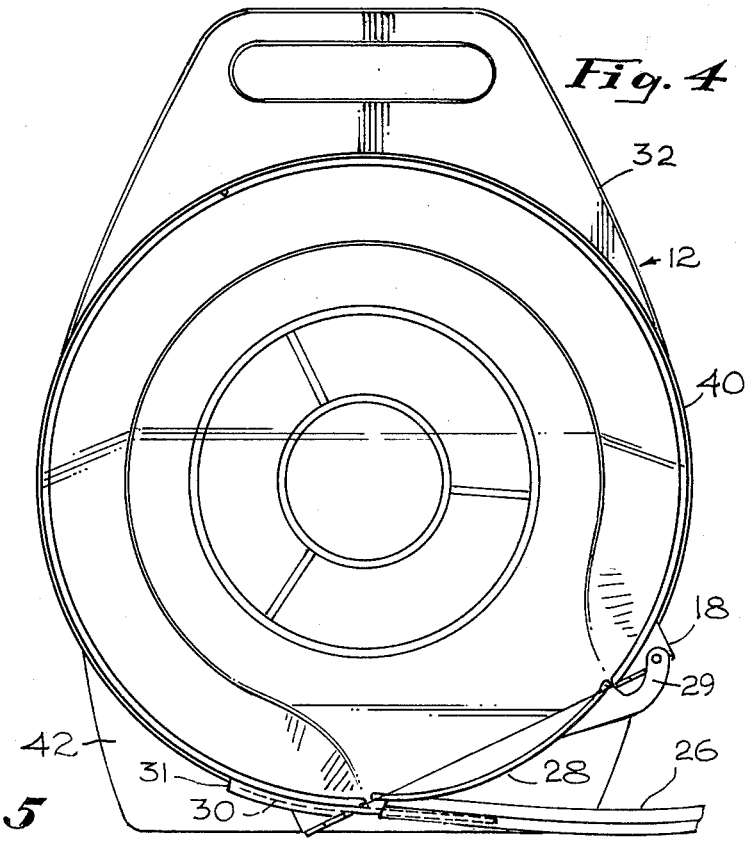

Referring now to FIGS. 3 and 4, there is shown another arrangement in which the case 12 is used as a loop-the-loop track layout for a powered car. In this arrangement, the case 12 is closed and the connector 30 is positioned in the slots 31. The flexible track section 26 is joined to the connector 30, and a vehicle 24 is placed thereon. When the vehicle 24 is released under power it proceeds up the track section 26 and encounters the cover 28. Upon meeting the cover 28 the vehicle 24 urges it inwardly upon its hinge 29 so that the cover 28 projects into the interior of the case 12 (as shown in FIG. 3). This allows the vehicle 24 to enter the case 12 where a path forming a circular loop-the-loop track is provided by the interior sides 40 of the base 14 and the top 16. Once the vehicle 24 has entered the case 12, the aperture in the case 12 between the hinges 18 is filled by the cover 28 the left end of which falls against and is held by the connector 30. Consequently, there is provided a complete cylindrical path through which the vehicles 24 may negotiate a loop-the-loop pattern.

It is obvious that the loop-the-loop pattern and the figure eight pattern provided by the toy racing set of this invention may both be negotiated by a vehicle 24 in quite cramped quarters. The figure eight pattern shown in FIG. 2 will be maintained even though the carrying case rests on an uneven surface such as the lap of a child because of the high side walls 40. The loop-the-loop arrangement shown in FIGS. 3 and 4 is provided with a base 42 which allows the case 12 to stand upright in the closed position in very close quarters. However, the arrangement may also be utilized even though no flat surface is available by holding the handle 32 of the case 12 as the vehicle 24 is operated.

Although various aspects and advantages of a preferred embodiment have been shown and described herein, it will be obvious to those skilled in the art that other arrangements might be constructed by those skilled in the art without departing from the spirit and scope of the invention.

What is claimed is:

1. A track layout for toy vehicles, comprising: two halves hinged together, each of the halves formed having an open end, a closed end, a wall having a cylindrical inner surface which surrounds the inner surface of the closed end, a segment of the wall being interrupted to form a gap in the wall; and means for hinging together the two halves which permits the halves to be folded together so that the open ends abut each other to cause the walls to form a cylindrical enclosure, and the gaps align with each other to form an opening into the enclosure, whereby the inner surfaces of the walls provide a first track, enclosed by the closed ends of each of the halves, for racing toy vehicles which are admitted into the interior of the enclosure via the opening, the means for hinging further permitting the halves to be unfolded so that their closed ends are coplanar and their walls abut such that the gaps in each are adjacent, whereby the inner surfaces of the closed ends provide a second track, totally surrounded by the walls of each of the halves, for racing toy vehicles between the two halves via the adjacent gaps.

2. The track layout of claim 1 further including a closure member swingably connected to the enclosure to form a continuation of the inner surface of the walls by acting as a closure for the opening therein, and where the toy vehicles may be used to swing the closure open to admit the vehicles into the interior of the enclosure to race around the inner surface of the walls in a loop-the-loop fashion.

3. The track layout of claim 1 further including a cylindrical member projecting from the center of the inner surface of the closed end of each of the halves to form the second track into a figure eight pattern, and where the interior of the cylindrical member is provided with compartments for storing the toy vehicles within the enclosure.

* * * * *